US007400312B2

(12) United States Patent
Hung et al.

(10) Patent No.: US 7,400,312 B2
(45) Date of Patent: Jul. 15, 2008

(54) COMMON VOLTAGE ADJUSTMENT CIRCUIT AND LIQUID CRYSTAL DISPLAY PANEL UTILIZING THE SAME

(75) Inventors: Chi-Mao Hung, Chiayi (TW); Po-Cheng Shih, Taipei (TW)

(73) Assignee: AU Optronics Corp., Hsinchu (TW)

( * ) Notice: Subject to any disclaimer, the term of this patent is extended or adjusted under 35 U.S.C. 154(b) by 813 days.

(21) Appl. No.: 10/919,868

(22) Filed: Aug. 17, 2004

(65) Prior Publication Data

US 2005/0219185 A1 Oct. 6, 2005

(30) Foreign Application Priority Data

Apr. 1, 2004 (TW) ..... 93109037 A

(51) Int. Cl.
*G09G 3/36* (2006.01)

(52) U.S. Cl. ..... 345/100; 341/154

(58) Field of Classification Search ..... 345/94, 345/87, 100; 341/154
See application file for complete search history.

(56) References Cited

U.S. PATENT DOCUMENTS 6,366,065 B1 * 4/2002 Morita ..... 323/280
7,138,996 B2 * 11/2006 Lee et al. ..... 345/214
2004/0046724 A1 * 3/2004 Woo et al. ..... 345/87

* cited by examiner

*Primary Examiner*—Richard Hjerpe
*Assistant Examiner*—Shaheda A Abdin
(74) *Attorney, Agent, or Firm*—Thomas, Kayden, Horstemeyer & Risley

(57) ABSTRACT

A common voltage adjustment circuit. The common voltage adjustment circuit is applied in a liquid crystal display panel having a plurality of display units, coupled to a common electrode. The common voltage adjustment circuit has a first register, a second register, a first digital-to-analog converter, a second digital-to-analog converter, and a regulator. The common voltage adjustment circuit adjusts AC voltage and DC voltage of the common voltage and provides the adjusted common voltage to the common electrode.

10 Claims, 4 Drawing Sheets

COMMON VOLTAGE ADJUSTMENT CIRCUIT AND LIQUID CRYSTAL DISPLAY PANEL UTILIZING THE SAME

BACKGROUND OF THE INVENTION

1. Field of the Invention

The present invention relates to a common voltage adjustment circuit, and in particular to a common voltage adjustment circuit employed in a liquid crystal display panel.

2. Description of the Related Art

FIG. 1 shows a schematic diagram of a conventional thin film transistor liquid crystal display (TFT-LCD) panel. As shown in FIG. 1, the TFT-LCD panel comprises a display array 1, a data driver 2, and a scan driver 3. The display array 1 is formed by interlaced data lines D11 to D1*y* and scan lines G11 to G1*x*. The interlaced data line and scan line correspond to one display unit, for example, interlaced data line G11 and scan line D11 display unit 100. Like any other display unit, the equivalent circuit of the display unit 100 comprises a thin film transistor (TFT) 10, a storage capacitor Cs10, and a liquid capacitor Clc10. One terminal of the liquid capacitor Clc10 is coupled to a common electrode providing a common voltage VCOM.

Typically, video signals transmitted by the data lines D11 to D1*y* are positive or negative sorted by relationship with the common voltage VCOM. Referring to FIG. 2, the common voltage VCOM comprises a direct current (DC) voltage Vcdc and an alternating current (AC) voltage Vcac. When the voltages Vcdc and Vcac are inappropriate, inaccurate display results.

FIG. 3 is an adjustment circuit 30 of a conventional TFT-LCD panel. Level of a DC voltage Vcdc is varied by adjusting a variable resistor 301, and an amplitude of an alternating current voltage Vcac is varied by adjusting a variable resistor 302, thereby modifying the common voltage VCOM to an appropriate value. Because the conventional adjustment circuit 30 is disposed outside the TFT-LCD panel, the volume of the printed circuit board and the cost both increase. Also, resistors 301 and 302 must be adjusted manually, further increasing time spent and cost.

SUMMARY OF THE INVENTION

Accordingly, an object of the present invention is to provide a common voltage adjustment circuit that ameliorates disadvantages of the related art.

According to one object, the present invention provides a common voltage adjustment circuit employed in a liquid crystal display panel comprising a plurality of display units, each coupled to a common electrode. The common voltage adjustment circuit comprises a first register, a second register, a first digital-to-analog converter, a second digital-to-analog converter, and a regulator. The first register stores a plurality of digital DC voltage values and outputs a corresponding digital DC voltage value according to a first indication signal. The second register stores a plurality of digital AC voltage values and outputs a corresponding digital AC voltage value according to a second indication signal. The first digital-to-analog converter, coupled to the first register, converts the received digital DC voltage value to a first value. The second digital-to-analog converter, coupled to the second register, converts the received digital AC voltage value to a second value. The regulator coupled to the digital-to-analog converters adjusts the first and the second voltage signals according to the first and the second values respectively and outputs the adjusted voltage signals to provide a common voltage to the common electrode.

The first voltage signal is a DC voltage signal with a voltage value varied in accordance with the first value, and the second voltage signal is an AC voltage signal with an amplitude varied in accordance with the second value.

A detailed description is given in the following embodiments with reference to the accompanying drawings.

BRIEF DESCRIPTION OF THE DRAWINGS

Various aspects of the present invention can be more fully understood by reading the subsequent detailed description and examples with references made to the accompanying drawings, wherein.

DETAILED DESCRIPTION OF THE INVENTION

Figure 1:
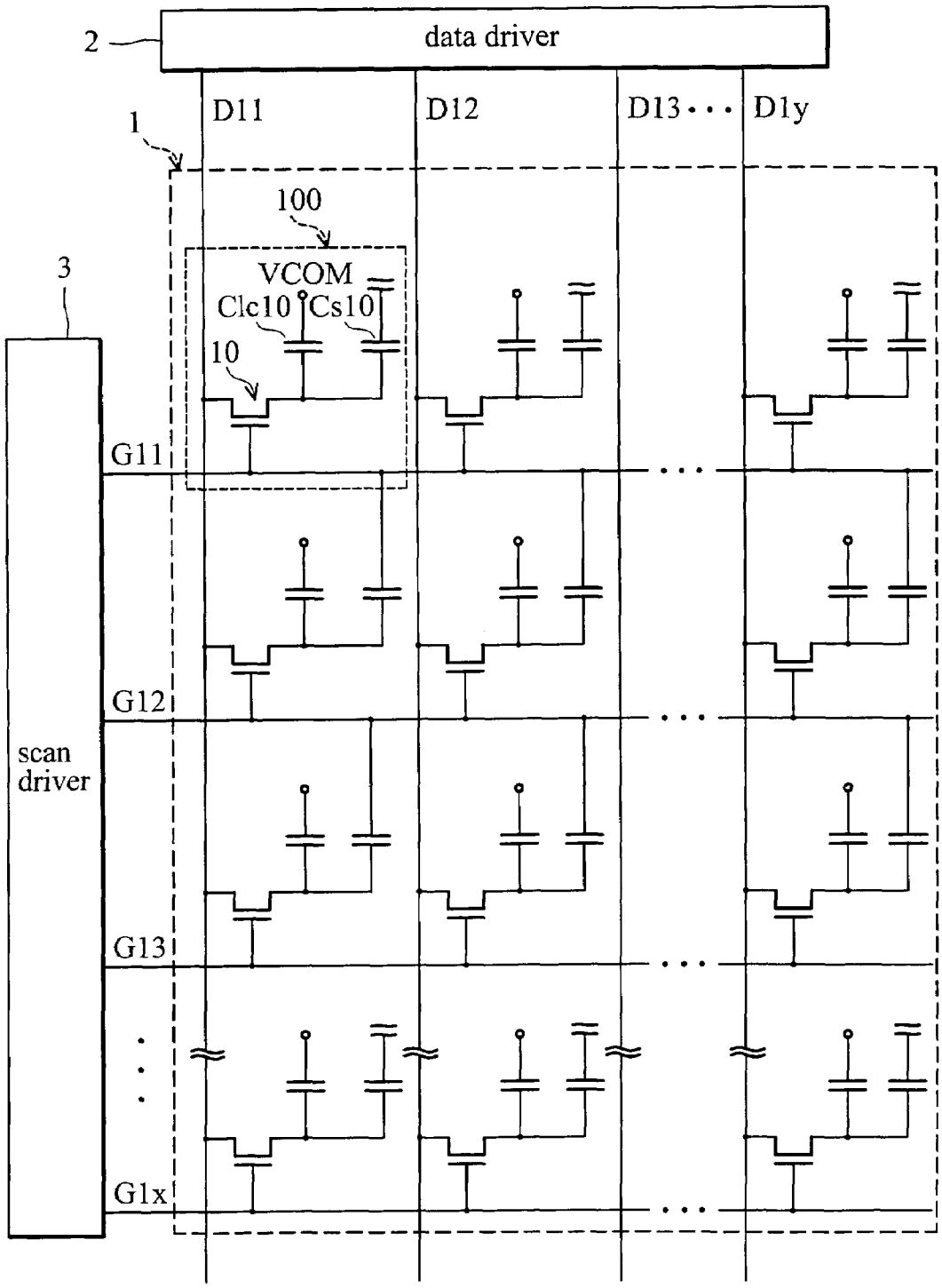
FIG. 1 (RELATED ART)
FIG. 1 shows a schematic diagram of a conventional TFT-LCD panel.
Figure 2:
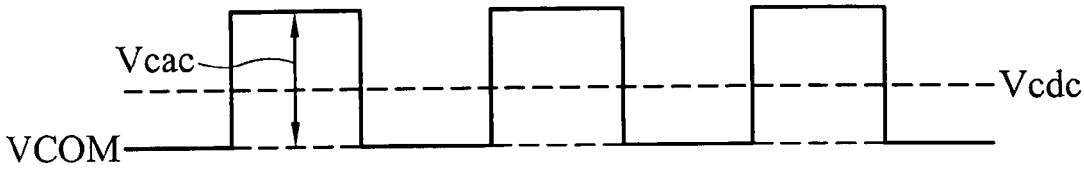
FIG. 2 (RELATED ART)
FIG. 2 is a common voltage signal.
Figure 3:
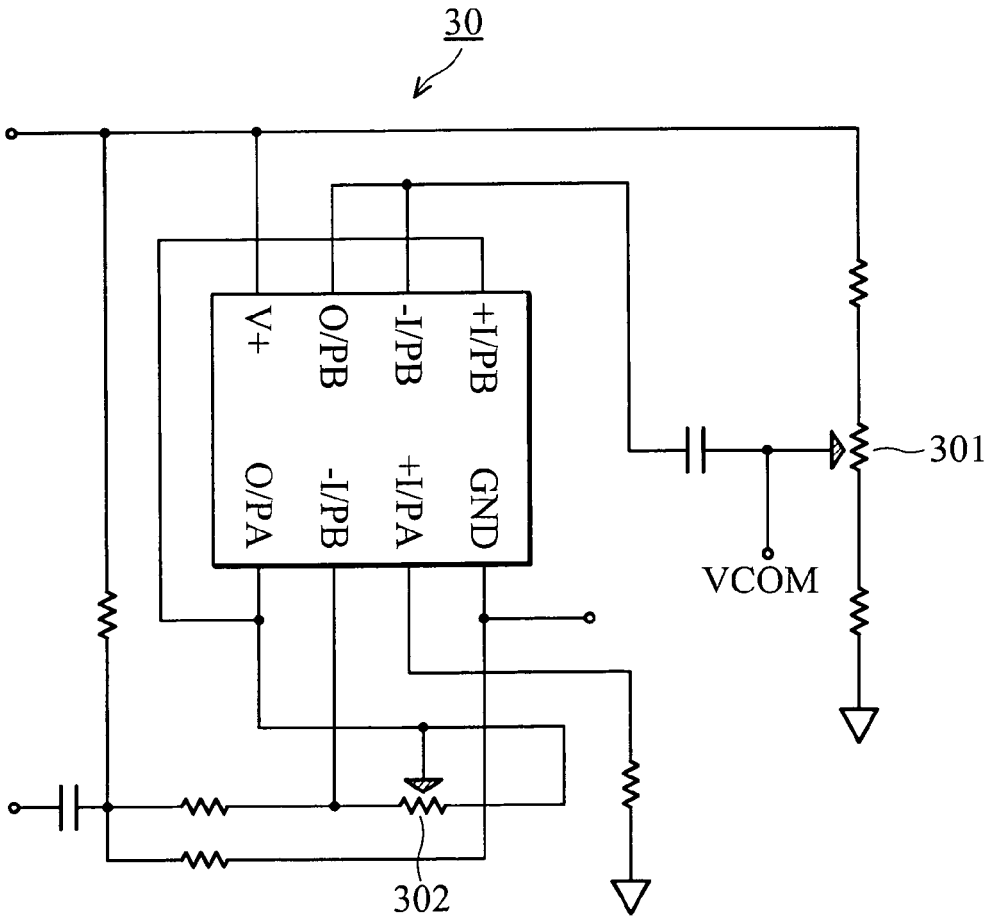
FIG. 3 (RELATED ART)
FIG. 3 is an adjustment circuit of a conventional TFT-LCD panel.
Figure 4:
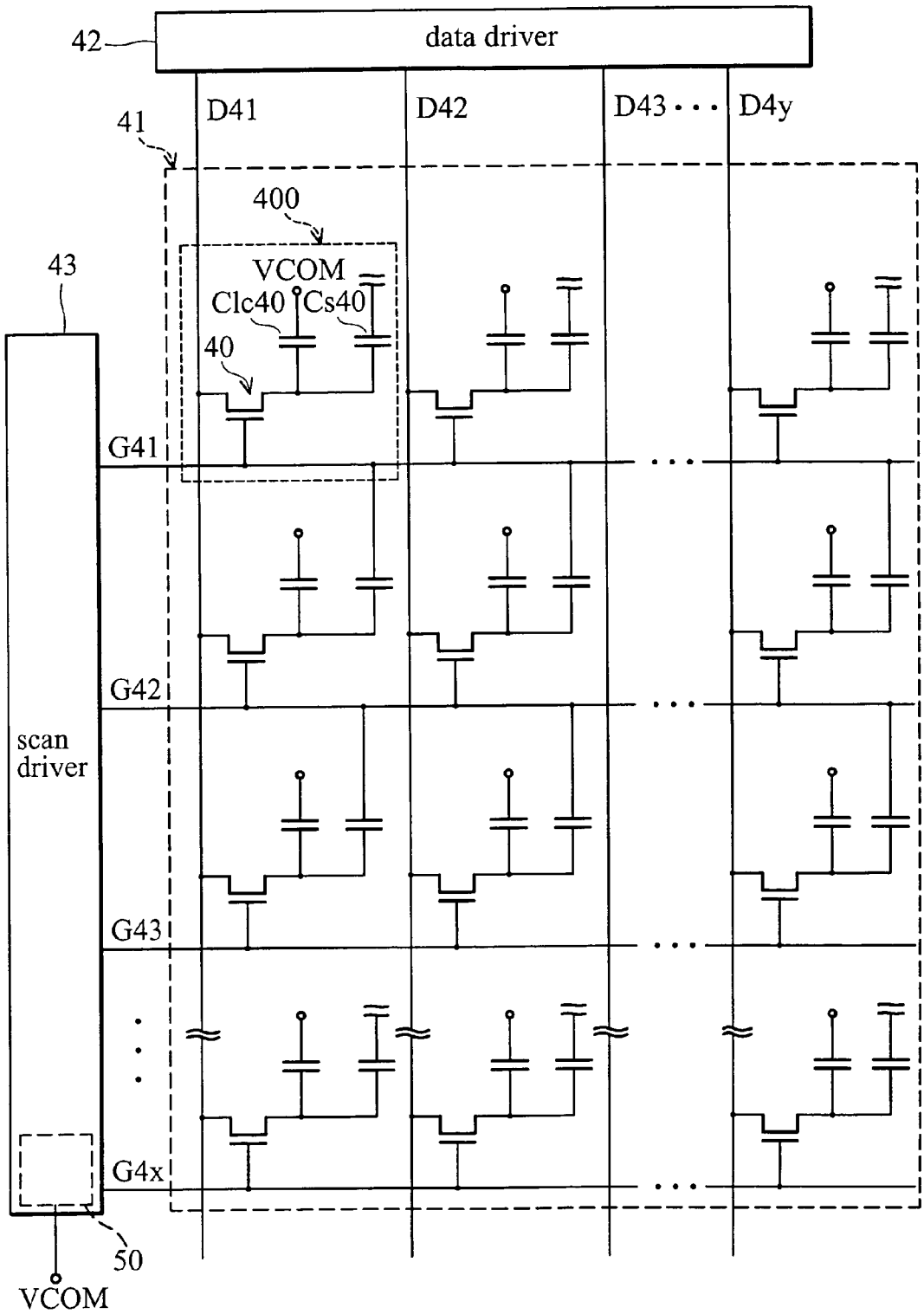
FIG. 4 shows a schematic diagram of a TFT-LCD panel of present invention.

FIG. 4 shows a schematic diagram of a TFT-LCD panel of the present invention. As shown in FIG. 4, the TFT-LCD panel comprises a display array 41, a data driver 42, and a scan driver 43. The display array 41 is formed by interlaced data lines D41 to D4*y* and scan lines G41 to G4*x*. The interlaced data line and scan line correspond to one display unit, for example, interlaced data line G41 and scan line D41 to a display unit 400. Like any other display unit, the equivalent circuit of the display unit 400 comprises a TFT 40, a storage capacitor Cs40, and a liquid capacitor Clc40. One terminal of the liquid capacitor Clc40 is coupled to a common electrode providing a common voltage VCOM. The scan driver 43 comprises a common voltage adjustment circuit 50.

Figure 5:
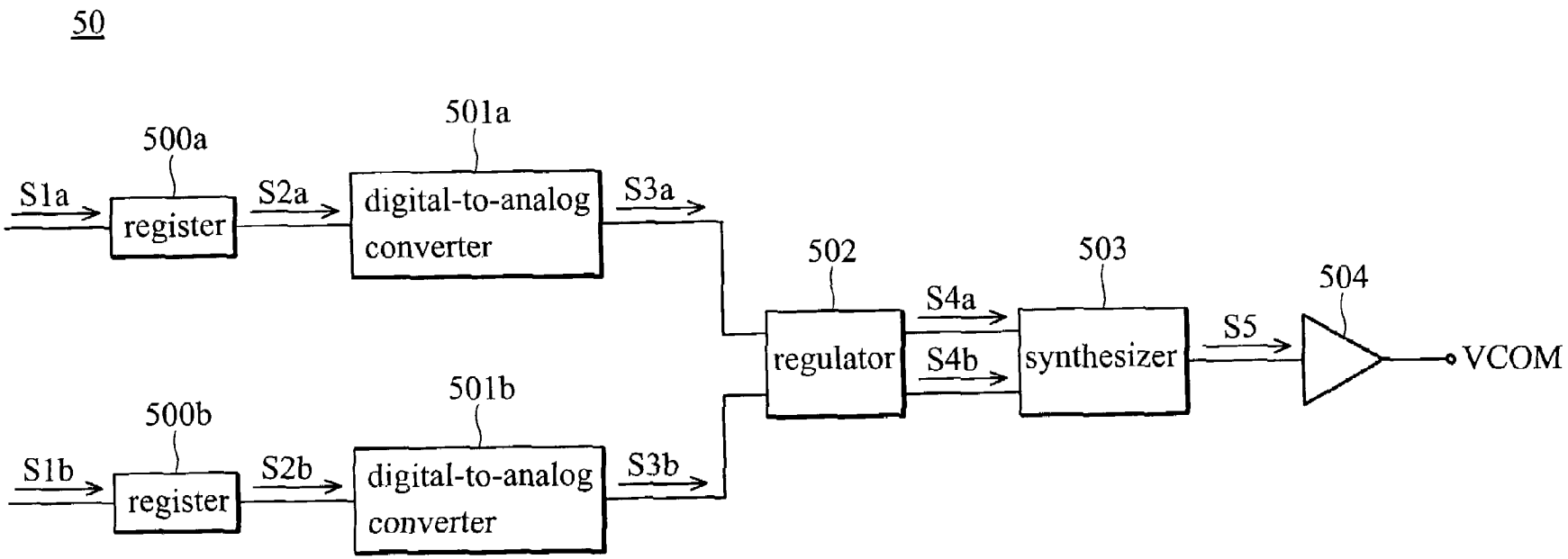
FIG. 5 is the common voltage adjustment circuit of the present invention.

FIG. 5 shows the common voltage adjustment circuit 50 comprising registers 500*a* and 500*b*, digital-to-analog converters 501*a* and 501*b*, a regulator 502, a synthesizer 503, and an amplifier 504. The register 500*a* stores a plurality of digital DC voltage values and receives an indication signal S1*a*. The register 500*a* outputs a corresponding digital DC voltage value S2*a* in accordance with the indication signal S1*a*. The digital-to-analog converter 501*a* coupled to the register 500*a* converts the digital DC voltage value S2*a* to an analog DC voltage value S3*a*. Similarly, the register 500*b* stores a plurality of digital AC voltage values and receives an indication signal S1*b*. The register 500*b* outputs a corresponding digital AC voltage value S2*b* in accordance with the indication signal S1*b*. The digital-to-analog converter 501*b* coupled to the register 500*b* converts the digital DC voltage value S2*b* to an analog DC voltage value S3*b*.

The regulator 502 is coupled to the digital-to-analog converters 501*a* and 501*b* and modifies voltage signals S4*a* and S4*b* according to the voltage values S3*a* and S3*b* respectively. The voltage S4*a* is a DC voltage signal with a voltage value varied in accordance with the analog DC voltage value S3*a*. The voltage signal S4*b* is an AC voltage signal with an amplitude varied in accordance with the analog DC voltage value S3*b*.

The synthesizer 503 receives the modified voltage signals S4*a* and S4*b* and synthesizes them to yield a voltage signal S5 for outputting to the amplifier 504. The amplifier 504 amplifies the voltage signal S5 to a common voltage VCOM and outputs the common voltage VCOM to the common electrode.

According to the present invention, the common voltage adjustment circuit 50 is disposed in the scan driver 43. In other applications, the common voltage adjustment circuit 50 can be disposed in the data driver 42. The digital values of the registers 500*a* and 500*b* are configured through an I2C (3-wire) bus. The I2C bus has fewer transmission lines and occupies less space. In the common voltage adjustment circuit 50, the configuration is controlled by the I2C bus.

The common voltage adjustment circuit adjusts AC and DC voltages of a common voltage. When flicker occurs on a display panel, the AC and DC voltages of the common voltage are modified by the common voltage adjustment circuit to appropriate values.

The common voltage adjustment circuit of the present invention is disposed in a data driver or a scan driver of a TFT-LCD panel, reducing requirement for external elements. Moreover, the adjustment rate and accuracy of a common voltage are upgraded by the configuration.

While several embodiments of the invention have been described by way of example, it is to be understood that the invention is not limited to the disclosed embodiments. To the contrary, it is intended that various modifications and similar arrangements (as would be apparent to those skilled in the art) be covered.

What is claimed is:

1. A common voltage adjustment circuit for a liquid crystal display panel comprising a plurality of display units, each coupled to a common electrode, the common voltage adjustment circuit comprising:

a first register storing a plurality of digital DC voltage values and outputting a corresponding digital DC voltage value according to a first indication signal;

a second register storing a plurality of digital AC voltage values and outputting a corresponding digital AC voltage value according to a second indication signal;

a first digital-to-analog converter coupled to the first register and converting the received digital DC voltage value to a first value;

a second digital-to-analog converter coupled to the second register and converting the received digital AC voltage value to a second value; and a regulator coupled to the first and the second digital-to-analog converters, adjusting a first and a second voltage signals according to the first and the second values respectively, and outputting the adjusted first and the adjusted second voltage signals to provide a common voltage to the common electrode;

wherein the first voltage signal is a DC voltage signal with a voltage value varied in accordance with the first value, and the second voltage signal is an AC voltage signal with an amplitude varied in accordance with the second value.

2. The common voltage adjustment circuit as claimed in claim 1, further comprising a synthesizer coupled to the regulator and synthesizing the first and the second voltage signals to the common voltage.

3. The common voltage adjustment circuit as claimed in claim 2, further comprising an amplifier coupled to the synthesizer and amplifying a value of the common voltage.

4. The common voltage adjustment circuit as claimed in claim 1, wherein the liquid crystal display panel further comprises a scan driver in which the common voltage adjustment circuit is disposed.

5. The common voltage adjustment circuit as claimed in claim 1, wherein the liquid crystal display panel further comprises a data driver in which the common voltage adjustment circuit is disposed.

6. A liquid crystal display panel comprising:

a scan driver;

a data driver;

a plurality of display units, each coupled to a common electrode; and a common voltage adjustment circuit comprising:

a first register storing a plurality of digital DC voltage values and outputting a corresponding digital DC voltage value according to a first indication signal;

a second register storing a plurality of digital AC voltage values and outputting a corresponding digital AC voltage value according to a second indication signal;

a first digital-to-analog converter coupled to the first register and converting the received digital DC voltage value to a first value;

a second digital-to-analog converter coupled to the second register and converting the received digital AC voltage value to a second value; and a regulator coupled to the first and the second digital-to-analog converters, adjusting a first and a second voltage signals according to the first and the second values respectively, and outputting the adjusted first and second voltage signals to provide a common voltage to the common electrode;

wherein the first voltage signal is a DC voltage signal with a voltage value varied in accordance with the first value, and the second voltage signal is an AC voltage signal with an amplitude varied in accordance with the second value.

7. The liquid crystal display panel as claimed in claim 6, further comprising a synthesizer coupled to the regulator and synthesizing the first and second voltage signals to the common voltage.

8. The liquid crystal display panel as claimed in claim 7, further comprising an amplifier coupled to the synthesizer and amplifying a value of the common voltage.

9. The liquid crystal display panel as claimed in claim 6, wherein the common voltage adjustment circuit is disposed in the scan driver.

10. The liquid crystal display panel as claimed in claim 6, wherein the common voltage adjustment circuit is disposed in the data driver.

* * * * *